US007267216B1

(12) United States Patent
Chang

(10) Patent No.: US 7,267,216 B1
(45) Date of Patent: Sep. 11, 2007

(54) COIN-OPERATED VENDING MACHINE WITH ANTI-THEFT PROTECTION

(76) Inventor: Kil Jae Chang, T. PiCO, Korea Manufacturing, 321-37 Suksu, 2 Dong, Anyang City, Kyungdido (KR)

( * ) Notice: Subject to any disclaimer, the term of this patent is extended or adjusted under 35 U.S.C. 154(b) by 0 days.

(21) Appl. No.: 11/451,855

(22) Filed: Jun. 12, 2006

(51) Int. Cl.
*G07F 9/10* (2006.01)

(52) U.S. Cl. ..... 194/350; 232/15

(58) Field of Classification Search ..... 194/350; 221/154; 232/15, 16
See application file for complete search history.

(56) References Cited

U.S. PATENT DOCUMENTS 3,430,746 A 3/1969 Bolen
3,804,294 A 4/1974 Householder
4,534,492 A 8/1985 Schwarzli
5,131,519 A 7/1992 Ra
5,259,532 A 11/1993 Schwarzli
5,647,471 A 7/1997 Ra
5,984,075 A 11/1999 Schwarzli

*Primary Examiner*—Patrick Mackey
*Assistant Examiner*—Jeffrey A Shapiro
(74) *Attorney, Agent, or Firm*—John R. Flanagan

(57) ABSTRACT

A coin-operated vending machine includes fastening elements adapted to be reached to fasten a lower base to an upper body by inserting a tool through openings in the lower base bottom once a coin box is removed from the lower base whereas the elements cannot be reached and unfastened when the openings are blocked by the coin box in the lower base, a transverse wall attached to an outer wall of the upper body and disposed across the upper body so as to block off access to the coin box by reaching through the upper body with a head of the machine removed, a central rod adapted to assemble the upper body to the head being fixedly attached upon the transverse wall, and a motion-responsive device operable in conjunction with a coin chute to permit coins only to pass through it from a coin-actuated mechanism to the coin box.

14 Claims, 7 Drawing Sheets

COIN-OPERATED VENDING MACHINE WITH ANTI-THEFT PROTECTION

BACKGROUND OF THE INVENTION

1. Field of the Invention

The present invention generally relates to a vending machine and, more particularly, is concerned with a coin-operated vending machine provided with anti-theft protection.

2. Description of the Prior Art

One general type of prior art vending machine, that has been manufactured and sold heretofore by the inventor herein, includes a merchandise storage and dispensing head, a housing supporting the head, a coin-actuated mechanism mounted on and extending into the interior of the housing to where the mechanism operably engages the head, and a coin box disposed in the housing below the mechanism for receiving coins from the operation of the coin-actuated mechanism. The housing typically includes an upper body and a lower base. The upper body has an interior compartment and supports the head at an upper open end of the upper body and, in turn, rests on the lower base at a lower open end of the upper body. The lower base is formed of interconnected bottom wall, end walls and side walls and open at a top where it supports the lower open end of the upper body. The coin box is typically housed in the lower base and accessible through one of the end walls by a key-actuated lock.

More particularly, the merchandise storage and dispensing head includes a globe, a hopper and a dispensing wheel. The globe is disposed above the upper open end of the upper body for storing the items of merchandise in the globe. The hopper is attached to and disposed below the globe and supported on the upper open end of the upper body. The dispensing wheel is seated within the hopper so as to underlie the globe and revolve in the hopper to dispense a preset amount of items of the merchandise from the globe, in response to operation of the coin-actuated mechanism, into a dispensing chute typically mounted to and disposed within the upper body below the dispensing wheel and extending to a location at the exterior of the upper body where the preset amount of items can be retrieved by a user.

The coin-actuated mechanism has exposed at the exterior of the upper body a coin deposit slot and a handle accessible for operation by a user. The handle can be rotated when one or more coins of correct denomination, or properly configured tokens, are inserted into the coin deposit slot. Rotation of the handle, in turn, rotates a gear meshing with a toothed edge of the dispensing wheel within the upper body compartment such that rotation of the coin-actuated mechanism causes the dispensing wheel to revolve and dispense merchandise through the dispensing chute. Also, as the coin-actuated mechanism completes its rotation the coin or token is discharged from it into the coin box in the lower base below the upper body compartment.

In this type of vending machine, the head and housing are held together by a central assembly rod which at a lower end bypasses the coin box and is threadably affixed to the bottom wall of the lower base. The central assembly rod extends therefrom upwardly from the lower base through the interior compartment of the upper body and therefrom through the dispensing wheel and the globe to a top cap which seats on and closes an open top of the globe. At such top location of the vending machine, an upper end of the assembly rod is locked into a top key-operated lock that is threaded onto the upper end of the central assembly rod so as to provide sufficient downward force against the top cap to secure together all components of the vending machine between the lower base and the top cap.

U.S. Pat. No. 3,430,746 to Bolen, U.S. Pat. No. 3,804,294 to Householder and U.S. Pat. No. 5,984,075 to Schwarzli disclose coin-operated vending machines generally the same as the general type described above, except that in these vending machines the lower end of the assembly rod is secured to a brace or bridge attached to and extending between opposite wall portions of the housing or lower base thereof above the coin box.

In order to change or replenish merchandise in the globe of the vending machine only the top key-operated lock and the top cap need to be removed, exposing the open top of the globe. However, once the top key-operated lock is released from the upper end of the central rod there is nothing to prevent the removal of the merchandise storage and dispensing head from the upper open end of the upper body of the housing. This can potentially lead to problems in those retail environments where vending machine access is not closely supervised with respect to maintenance of control over who is present or has access to the key for unlocking the top lock during a globe refilling operation. Under such circumstances, a dishonest employee or bystander might be able to temporarily remove the head, then reach downward through the compartment of the upper body to the location of the coin box in the lower base and, without authorization, remove whatever amount of coins that can be quickly grabbed.

As one potential solution to the foregoing problem, U.S. Pat. Nos. 5,131,519 and 5,647,471 to Ra disclose, as an original installation or a retrofit, the construction of an internal lock safe or box arrangement within the housing or body of the vending machine which employs a lockable top cover in the form of a flat plate disposed within the housing just below the dispensing wheel, above the coin mechanism, and lockable to a peripheral shelf of the lock box arrangement by a key-operated lock. The lock box arrangement also employs brackets (or a liner) providing the shelf for seating the lockable cover at the top and attached via a base retainer (or bottom plate) to a base plate of the housing at the bottom. Thus, only persons with access to a key to the particular lock device on the lockable top cover of the internal lock box arrangement can remove coins from the interior of the housing below the top cover. The central assembly rod is attached at its lower end on the base plate of the housing and extends upwardly through the lock box arrangement, via a base retainer as well as the top cover, to and through the top cap where by use of the top key-operated lock the central rod is made to fasten together the housing, via its base plate, and the merchandise storage and dispensing head. With the lock box arrangement top cover so locked, an operator can unlock the top lock and remove the head to allow filling of the head with product and then replace it on the housing. Also, the operator can remove a locked coin box-containing housing for later opening of the locked cover by a key operator and replace that housing with an empty housing (having its locked cover in place therein) such that access to the locked coin-box containing housing is provided only to persons with a key to the lock of the top cover, thus minimizing the potential for unauthorized coin removal.

While the internal lock box arrangement of the Ra patents appear to be a step in the right direction toward preventing unauthorized access to coins, this approach forgoes the highly desirable use of a separate coin box lockably and removably installed in the lower base of the housing, as in the above-described general type of vending machine manufactured and sold heretofore by the inventor herein and others. The use of the separate coin box obviates the need to replace the entire vending machine body when filled with coins and so reduces an expensive inventory requirement of maintaining on hand an extra quantity of vending machine bodies just for replacing the entire vending machine body whenever removal of the coins is warranted. Further, the manner in which the edge of the lock cover, opposite from its locked edge, is retained to the housing would appear to render it vulnerable to being pried loose or freed merely by using a screwdriver or the like so as to bypass the protection of the lock.

Consequently, the approach of the Ra patents does not seem to provide an optimum solution for the problem at hand at least with respect to the general type of vending machine described above. Therefore, a need still exists for an approach which will provide a solution to the aforementioned problem in the prior art without introducing any new problems in place thereof.

SUMMARY OF THE INVENTION

The present invention provides a coin-operated vending machine equipped with anti-theft protection designed to satisfy the aforementioned need. The approach of the present invention allows retention of the use of a separate removable coin box lockable in the lower base of the housing of the vending machine which is only temporarily unlocked and removed from the machine to access and remove the coins collected in it, after which the same coin box is replaced and locked back into the lower base of the housing. Only a few modifications and/or additions need to be implemented, either as an original installation in new vending machines or as a retrofit in existing vending machines, in relatively straightforward and simple manner in order to provide the anti-theft protection of the present invention and thereby prevent unauthorized access via a disassembled vending machine housing to the coins in the separate coin box in the lower base of the housing during refilling of the head of the vending machine with merchandise. Furthermore, the particular manner in which the anti-theft arrangement of the present invention is implemented obviates the possibility of someone bypassing its anti-theft protection.

Accordingly, the present invention is directed to a coin-operated vending machine provided with anti-theft protection. The vending machine comprises: (a) a head adapted to store items of merchandise and dispense a preset number of the items at a time therefrom; (b) a housing including an upper body having an outer wall defining an interior compartment open at upper and lower ends of the outer wall and adapted to removably support the head on the upper end, and a lower base defining an interior cavity and having an open top adapted to removably support the upper body thereon; (c) a coin box in the interior cavity of said lower base; (d) a first lock operable to permit removal and return of the coin box from and to the lower base; (e) a coin-actuated mechanism mounted on the upper body and operable by a user after deposit of at least one coin therein to cause dispensing of items from the head and ejection of the coin to the coin box in the lower base; (f) a plurality of elements disposed in the interior cavity of the lower base and the interior compartment of the upper body and adapted to fasten the lower base to the upper body, the lower base having a plurality of openings defined in a bottom thereof for allowing insertion of a tool, when the coin box is removed from the lower base, from exteriorly of the bottom of the lower base through the openings to reach and engage selected ones of the elements to fasten the lower base to the upper body such that access by the tool through the openings to the selected ones of the elements, and thus unfastening of the lower base from the upper body, cannot be reached and thus is blocked when the coin box is disposed in the interior cavity of the lower base; and (g) a transverse wall disposed across the interior compartment of the upper body, spaced from the upper and lower open ends of the upper body, and attached from below at a periphery thereof to the outer wall of the upper body such that the transverse wall blocks off access to the coin box in the interior cavity of the lower base by anyone reaching through the interior compartment of the upper body from the upper end thereof during when the head is removed from the upper body and such that the transverse wall cannot be detached from the upper body from above the transverse wall.

The machine also includes a coin chute and a motion-responsive coin blocking device. The coin chute is mounted in the interior compartment of the upper body and adapted to receive a coin from the coin-actuated mechanism and route the coin to a discharge end of the coin chute where the coin is discharged into the coin box located in the lower base of the housing, the transverse wall having another opening to accommodated extension therethrough of the coin chute from above to below the transverse wall. The motion-responsive coin blocking device is mounted below the transverse wall adjacent to the coin chute and adapted to only permit coins to pass through the coin chute in one direction from the coin-actuated mechanism to the coin box.

The machine further includes a top cap restable on a top open end of the head so as to close the top open end thereof, a central rod fixedly attached at a lower end to the transverse wall and extending therefrom upwardly above the transverse wall through the interior compartment of the upper body and therefrom through the head to the top cap; and a second lock operable to lock to an upper end of the central rod so as to hold and secure together the head and the upper body between the top cap and the transverse wall.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Vending Machine—In General

Figure 1:
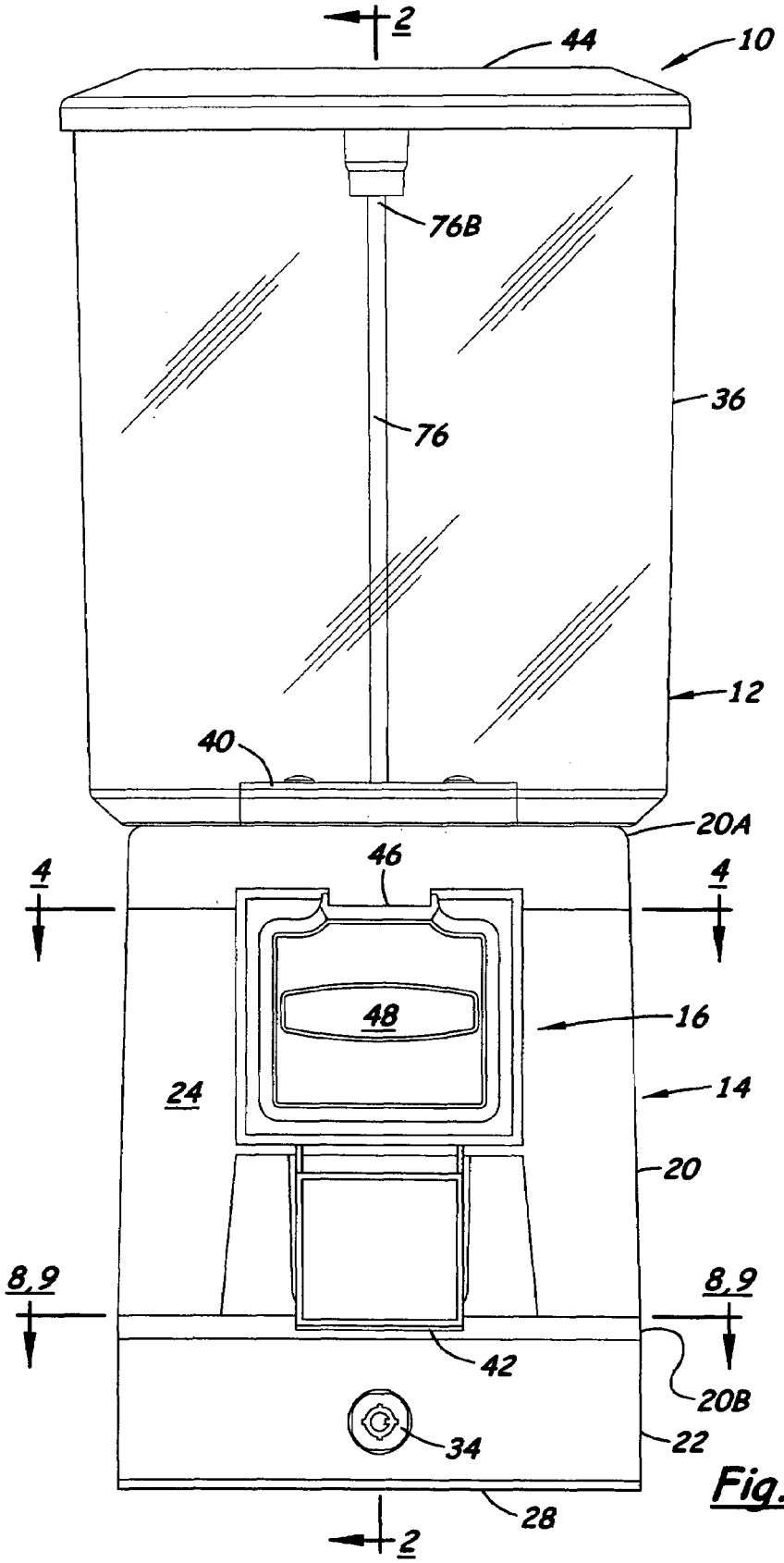
FIG. 1 is a front elevational view of a coin-operating vending machine of the present invention.
Figure 2:
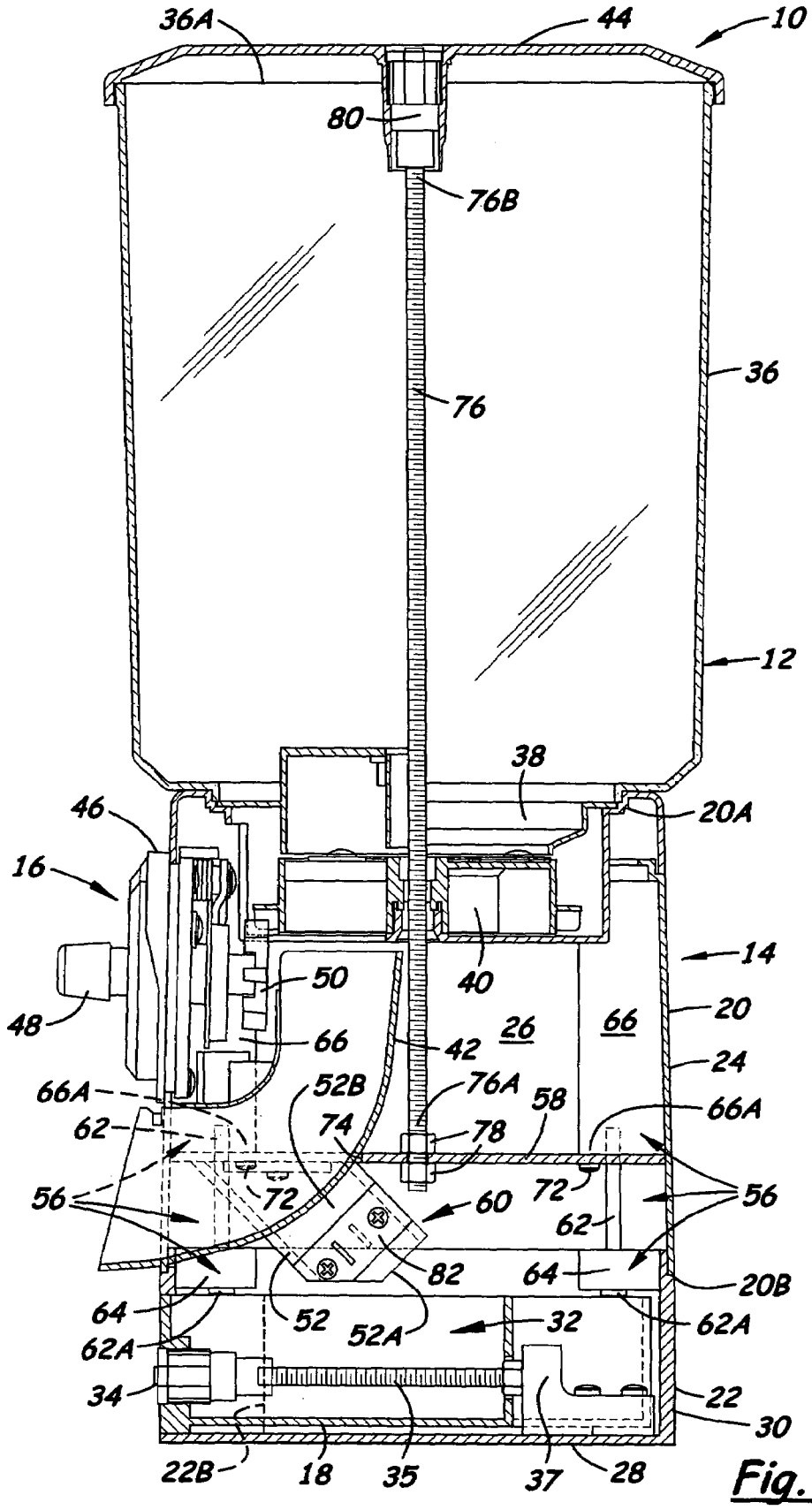
FIG. 2 is a vertical sectional view of the machine taken along line 2-2 of FIG. 1.
Figure 3:
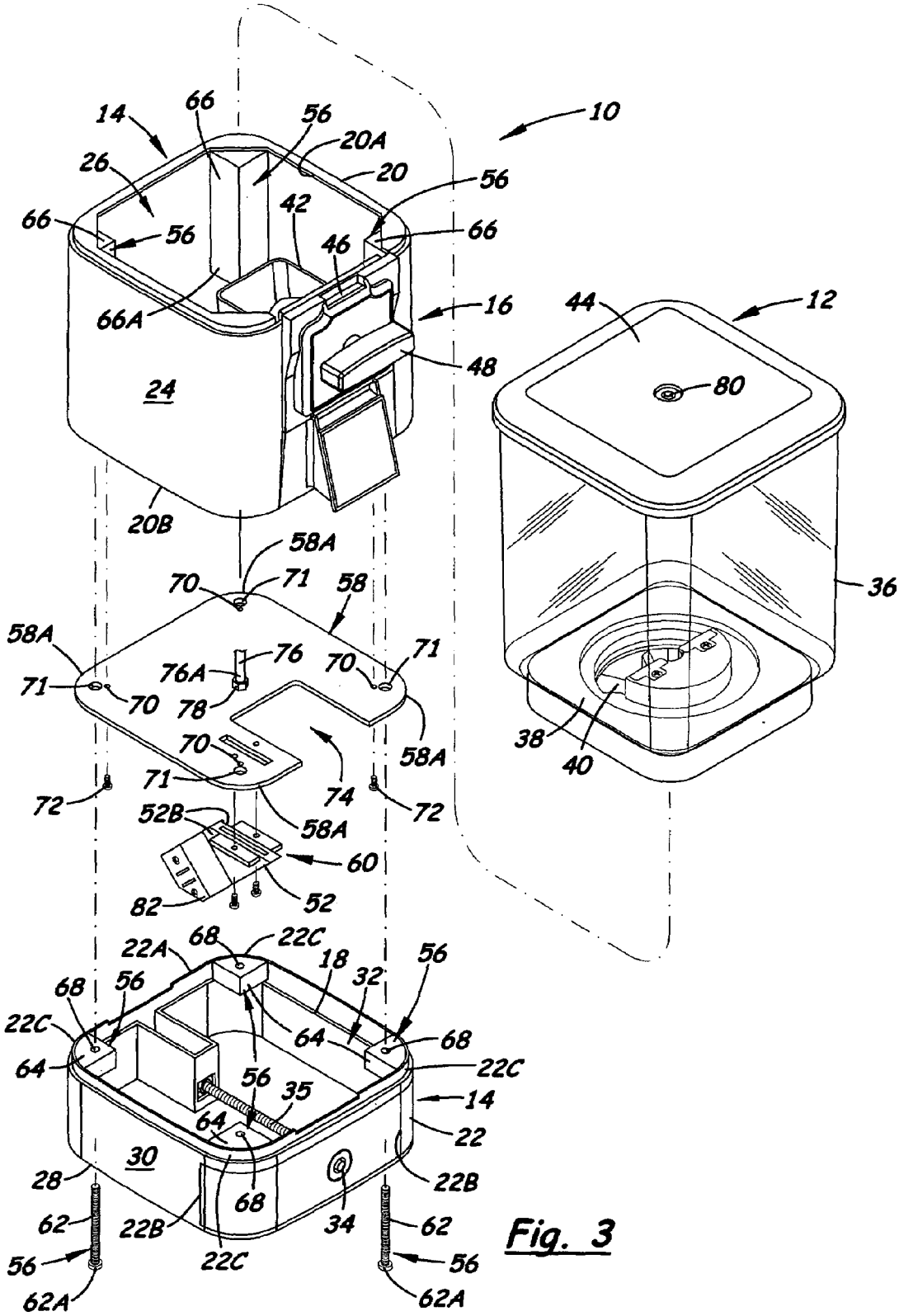
FIG. 3 is an exploded view of the machine of FIG. 1.
Figure 4:
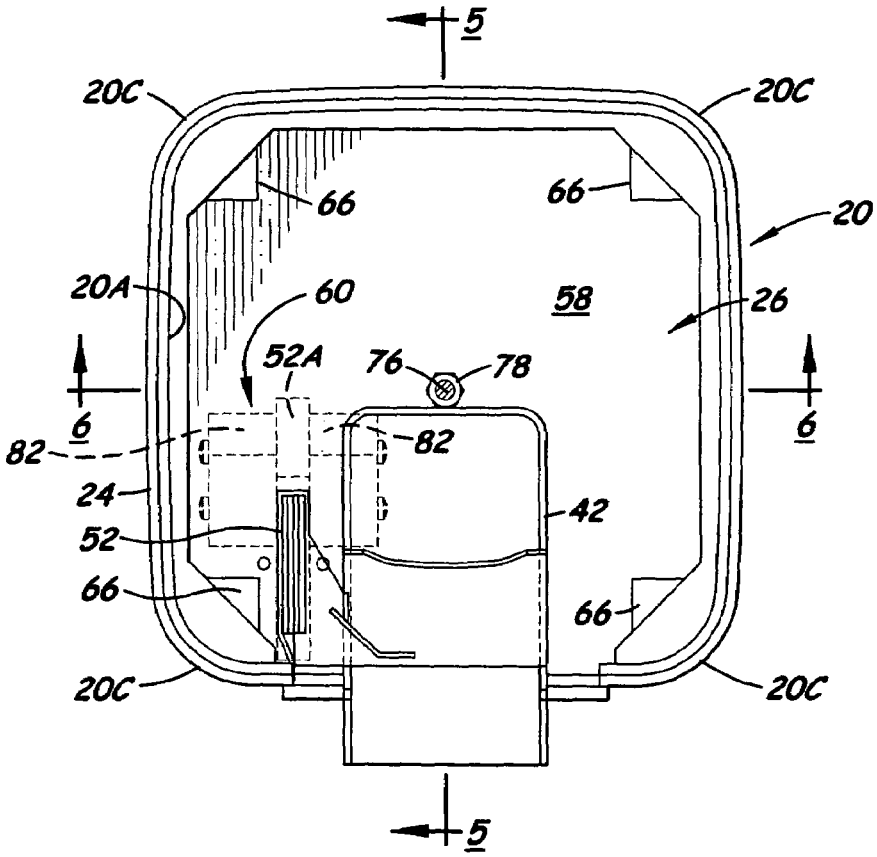
FIG. 4 is a top view of an upper body of a housing of the vending machine with a coin-actuated mechanism of the machine removed.
Figure 5:
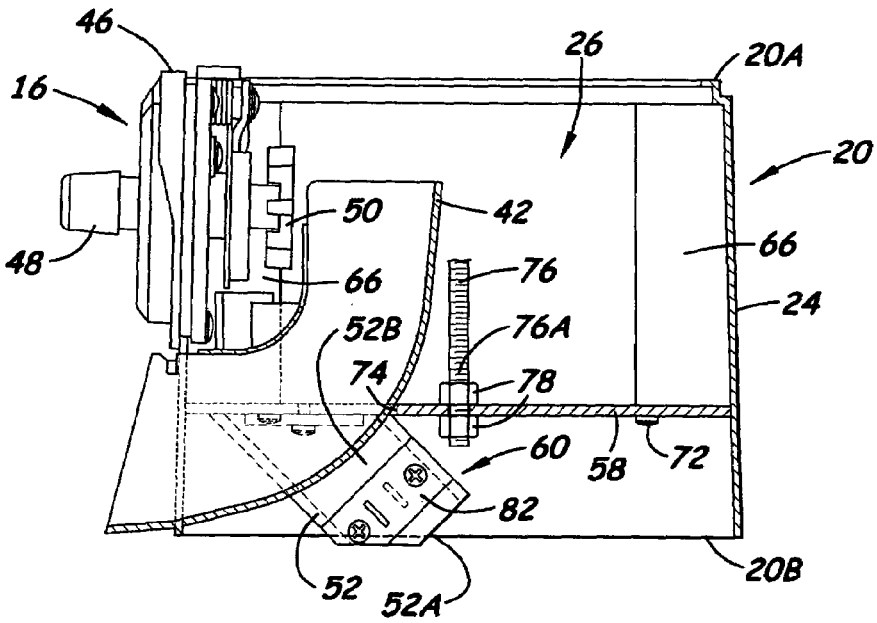
FIG. 5 is a vertical front-to-back sectional view of the upper body taken along line 5-5 of FIG. 4.
Figure 6:
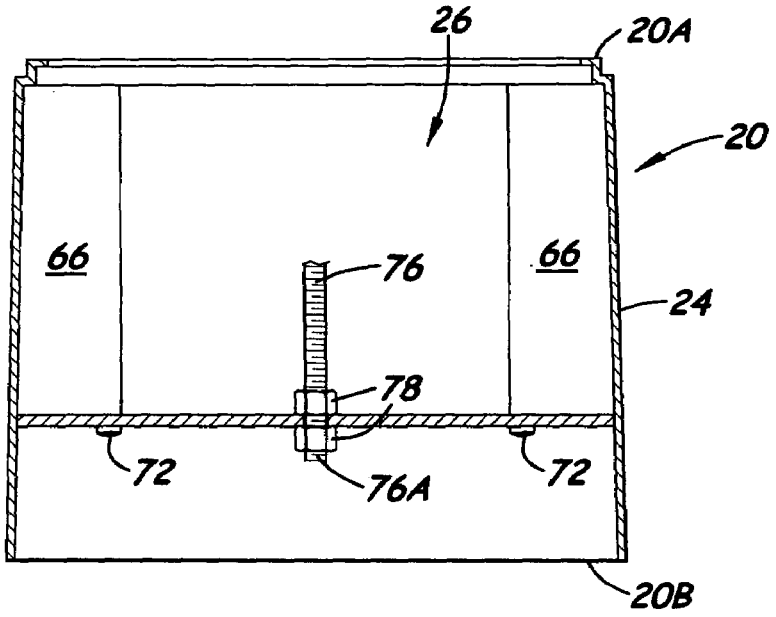
FIG. 6 is a vertical side-to-side section view of the upper body taken along line 6-6 of FIG. 4.
Figure 7:
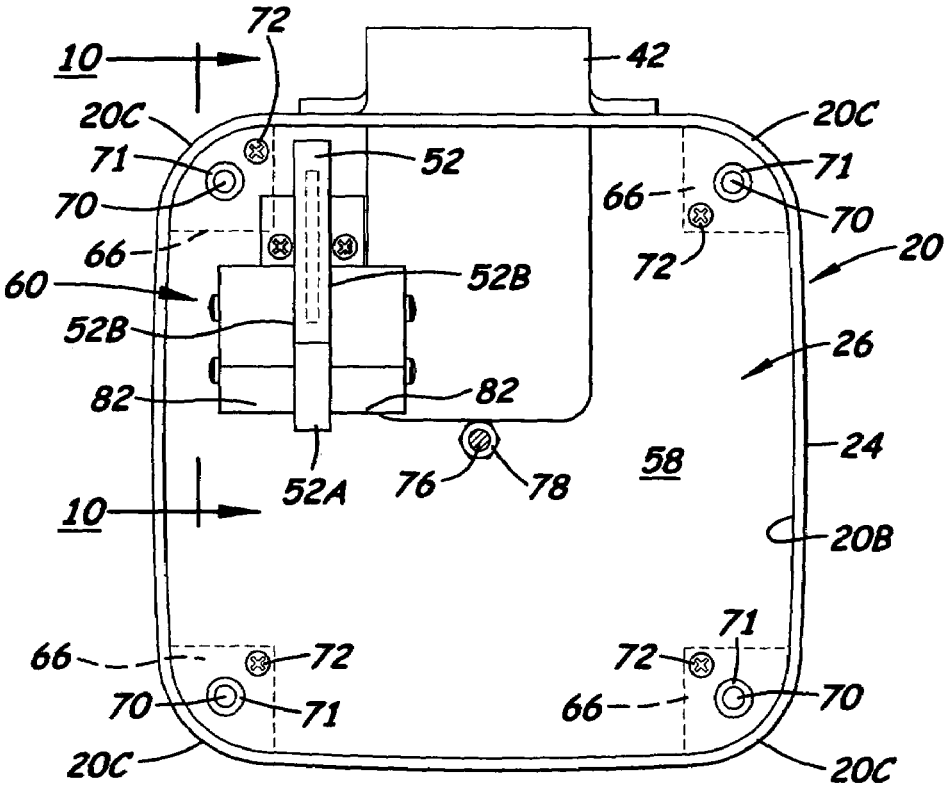
FIG. 7 is a bottom view of the upper body without the coin-actuated mechanism.

Referring to the drawings and particularly to FIGS. 1 to 3, there is illustrated a coin-operated vending machine, generally designated 10, being equipped in accordance with the present invention for preventing theft of coins therefrom due to partial disassembly of the vending machine that takes place during refilling of the vending machine with merchandise.

Figure 10:
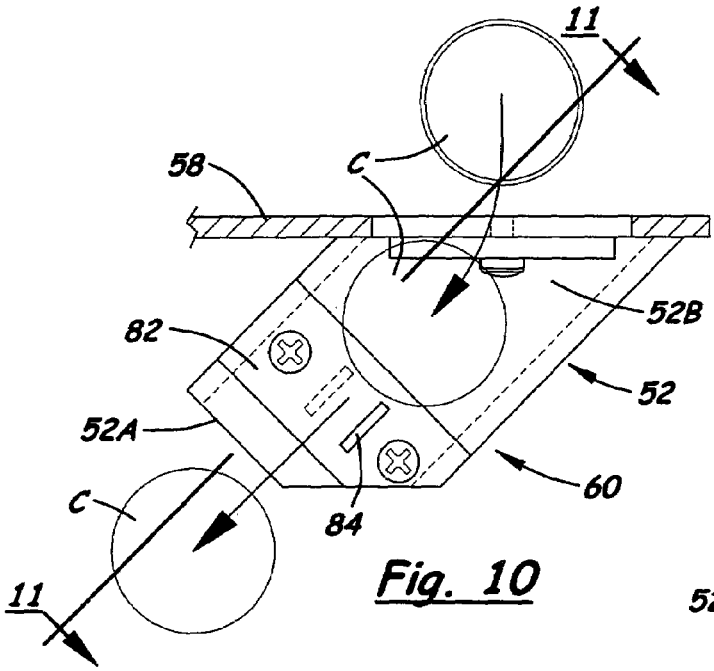
FIG. 10 is an enlarged side elevational view of a coin chute in the vending machine and a motion-responsive coin blocking device employed therein for preventing reverse travel of coins back through the coin chute in response to the vending machine being turned upside down and shaken from side to side.

Basically, the vending machine 10 includes a merchandise storage and dispensing head 12, a housing 14 supporting the head 12, a coin-actuated mechanism 16 mounted on and extending into the interior of the housing 14 to where the mechanism 16 operably engages the head 12, and a coin box 18 disposed in the housing 14 below the mechanism 16 for receiving coins C (see FIG. 10) discharged due to the operation of the mechanism 16. The housing 14 includes an upper body 20 and a lower base 22. The upper body 20 has an outer side wall 24 defining an interior compartment 26 and supporting the head 12 at an upper open end 20A of the upper body 20 and, in turn, rests on the lower base 22 at a lower open end 20B of the upper body 20. The lower base 22 has a bottom wall 28 and an outer side wall 30 defining an interior cavity 32 open at a top 22A and a front 22B of the lower base 22. The lower open end 20B of the upper body 20 rests on the open top 22A of the lower base 22. The coin box 18 is housed in the interior cavity 32 of the lower base 22 and is accessible and removable, and then returnable or reinstallable, through the open front 22B of the lower base 22 by operating a key-actuated lock device 34 releasably connected to a threaded rod 35 protruding from an upstanding bracket 37 attached upon the bottom wall 28 of the lower base 22.

The merchandise storage and dispensing head 12 includes a globe 36, a hopper 38 and a dispensing wheel 40. The hopper 30 is attached to and disposed across and below an open bottom of the globe 36 and supported on the upper open end 20A of the upper body 20 of the housing 14 such that the globe 36 can hold items of the merchandise to be dispensed from the globe 36 through the hopper 38. The dispensing wheel 40 is seated within the hopper 38 so as to underlie the globe 36 and is revolvable in the hopper 38 to dispense a preset amount of items of the merchandise from the globe 36. The items of merchandise are dispensed from the wheel 40 into a dispensing chute 42 mounted to and disposed within the upper body 20 below the dispensing wheel 40 and extending to a location at the exterior of the upper body 20 where the dispensed items can be retrieved by a user. The vending machine 10 also includes a top cap 44 restable on a top open end 36A of the globe 36 so as to overlie and close the globe 36 and prevent access into the globe 36.

The coin-actuated mechanism 16 has exposed at the exterior of the upper body 20 a coin deposit slot 46 and a handle 48 accessible for operation by a user. The handle 48 can be rotated when one or more coins of correct denomination (or properly configured tokens) are inserted into the coin deposit slot 46. Rotation of the handle 48, in turn, rotates a gear 50 meshing with a toothed edge of the dispensing wheel 40 within the upper body compartment 24 such that rotation of the coin-actuated mechanism 16 causes the dispensing wheel 40 to revolve and dispense merchandise through the dispensing chute 42. Also, as the coin-actuated mechanism 16 completes its rotation the coin is discharged from it down a coin chute 52 located above the lower base 22. From a lower discharge end 52A of the coin chute 52, the coin drops into the coin box 18 in the lower base 22 below the upper body compartment 24.

Anti-Theft Protection Components

As seen in FIGS. 3-13, anti-theft protection components of the present invention are provided in the vending machine 10. These components basically include a plurality of openings 54 defined in the bottom wall 28 of the lower base 22 at respective ones of four corners 28C thereof, a plurality of fastening elements, generally designated 56, adapted to fasten the lower base 22 to the upper body 20, a transverse wall 58 disposed in the upper body 20, and a motion-responsive coin blocking device 60 mounted to a bottom side of the transverse wall 58 adjacent to the coin chute 52 and being operable in conjunction with the coin chute 52 to permit coins only to pass through it from the coin-actuated mechanism 16 to the coin box 18 and not the reverse.

Figure 8:
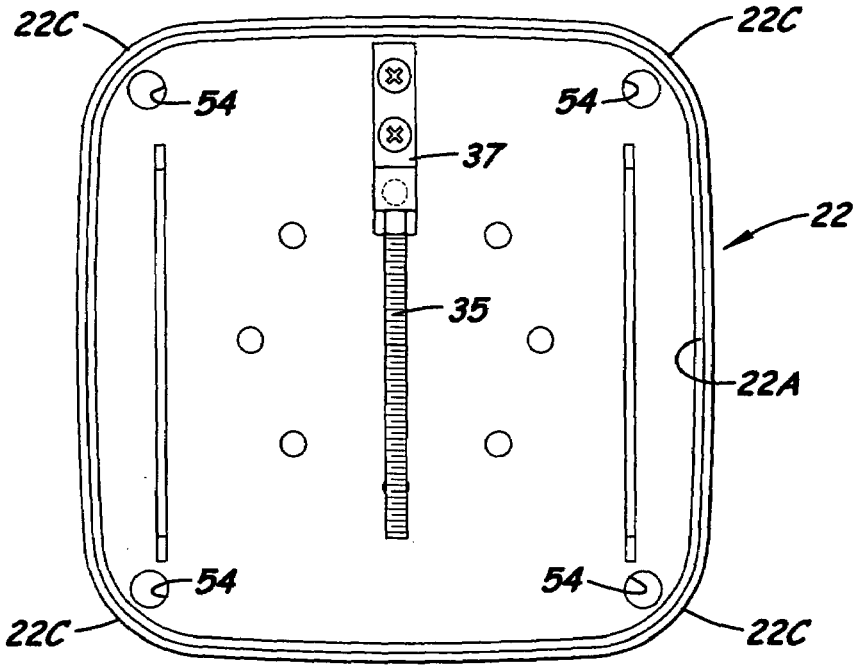
FIG. 8 is a top view of a lower base of the vending machine housing with a coin box removed from the lower base.
Figure 9:
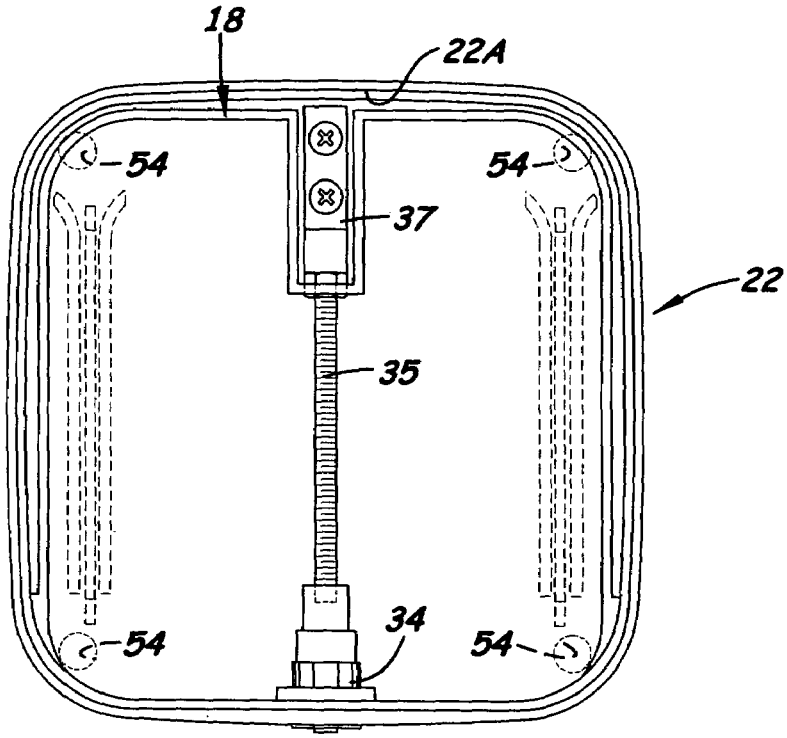
FIG. 9 is a bottom view similar to that of FIG. 8 but with the coin box reinstalled in the lower base.

More particularly, as seen in FIGS. 2-9, the plurality of fastening elements 56 includes a plurality (preferably four in number) of fastener screws 62, a plurality (preferably four in number) of first ledges 64 affixed in the lower base 22 at interior upper corners 22C thereof adjacent the upper open end 22A thereof, and a plurality of second ledges 66 affixed in the upper body 20 at interior corners 20C thereof above the location of the transverse wall 58. Each of the first ledges 64 has a bore 68 defined therethrough which is aligned with one of the openings 54 at the corners 28A of the bottom wall 28 of the lower base 22. Each of the second ledges 66 has a threaded hole 70 defined therein which is aligned with one of the openings 54 in the bottom wall 26 of the lower base 22, a hole 71 in each corner 58A of the transverse plate 58, and one of the bores 68 in the first ledges 64, when the upper body 20 is supported on the lower base 22 such that, when the coin box 18 is removed from the lower base 22 (as seen in FIG. 8), each one of the fastener screws 62 can be inserted through one of the openings 54, aligned with a correspondingly aligned one of the bores 68 and holes 71, finally, threaded into the correspondingly aligned threaded hole 70 to thereby fasten the lower base 22 and upper body 20 together. The heads 62A of the fastener screws 62 are disposed above the coin box 18 when it is installed in the lower base 22 such that access to each the screw heads 62A is blocked when the coin box 18 is present in the lower base 22 (as seen in FIG. 9). Thus, the fastener screws 62 are adapted to be reached to fasten or unfasten the lower base 22 to or from the upper body 20 by inserting a tool, such as a screwdriver, from the exterior of the lower base 22 through openings 54 in the lower base bottom wall 26 but only once the coin box 18 has been removed from the lower base 22. Thus, one needs to be able to unlock and remove the coin box 18 in order to disassemble the lower base 22 from the upper body 20 since the fastener screws 62 cannot be reached when the coin box 18 is present in the lower base 22 blocking or obstructing extension of the screwdriver through the openings 54 to the locations of the screws 62.

As seen in FIGS. 4-7, the transverse wall 58 is attached from below and at its periphery to the outer side wall 24 of the upper body 20 and is disposed across the interior compartment 26 of the upper body 20 and spaced from both the upper and lower open ends 20A, 20B of the upper body 20, preferably, at an intermediate level located between the coin-actuated mechanism 16 and the discharge end 42A of the discharge chute 42. Specifically, the transverse wall 58 takes the shape of a relatively flat plate and at its corners 58A receives fasteners 72 so as to fasten the transverse wall 58 from below to lower ends 66A of the second ledges 66 in the upper body 20. The fastening of the transverse wall 58 to the upper body 20 from below renders it impossible to remove the transverse wall 58 from above; so the clear intent is that the transverse wall 58 be an irremovable permanent structure in the machine 10 as far as users of the machine are concerned. Also, the presence of the coin box 18 in the lower base 22 also prevents access to the fasteners 72 from below. Further, the transverse wall 58 has an opening 74 for accommodating passage therethrough of the discharge chute 42 such that the transverse wall 58 blocks off access to the coin box 18 in the interior cavity 32 of the lower base 22 by anyone attempting to reach through the interior compartment 26 of the upper body 20 during when the head 12 is removed from the upper body 20. The central assembly rod 76 is fixedly attached at its lower end 76A in any suitable manner, such as by a pair of lock nuts 78, to the transverse wall 58 and extends therefrom upwardly through the interior compartment 26 of the upper body 20 and through the head 12 to an upper end 76B whereby via the use of a top key-actuated lock device 80 the central assembly rod 76 is locked to the top cap 44 so as to fixedly assemble together the housing 14 (via the upper body 20 and not via the lower base 22 as was done heretofore), the head 12 and the top cap 44.

Referring to FIGS. 2-5, 7 and 10-13, the motion-responsive coin blocking device 60 is mounted below the transverse wall 58 adjacent to the coin chute 52 and adapted to only permit coins to pass through the coin chute 52 in one direction, that being from the coin-actuated mechanism 16 to the coin box 18. Thus, the blocking device 60 will obstruct the removal of coins from the coin box 18 in the lower base 22 back through the coin chute 52 in response to anyone, for example, turning of the vending machine 10, or just the housing 12, upside down and shaking it from side to side.

Figure 11:
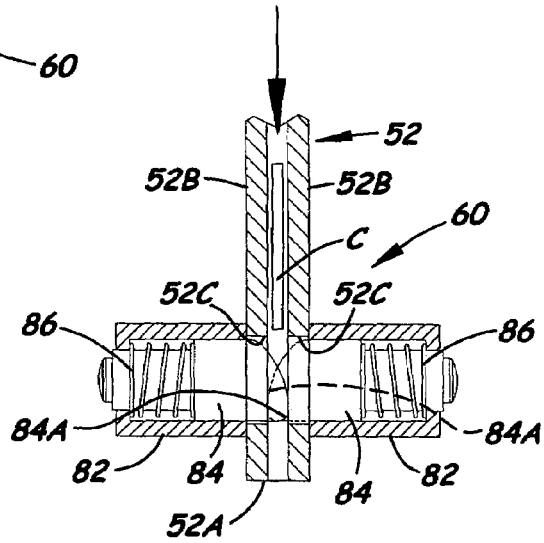
FIG. 11 is an enlarged sectional view taken along line 11-11 of FIG. 10 showing a coin traveling down the coin chute prior to causing displacements of spring-biased dogs of the coin blocking device relative to the coin chute.
Figure 12:
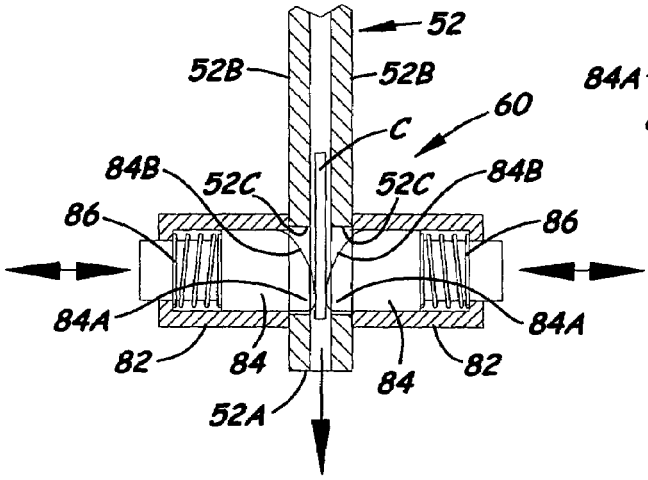
FIG. 12 is a view similar to that of FIG. 11 now showing positions of the dogs after their yielding displacements in opposite directions away from the coin chute in response to the coin contacting and moving downward between curved inner ends of the dogs.
Figure 13:
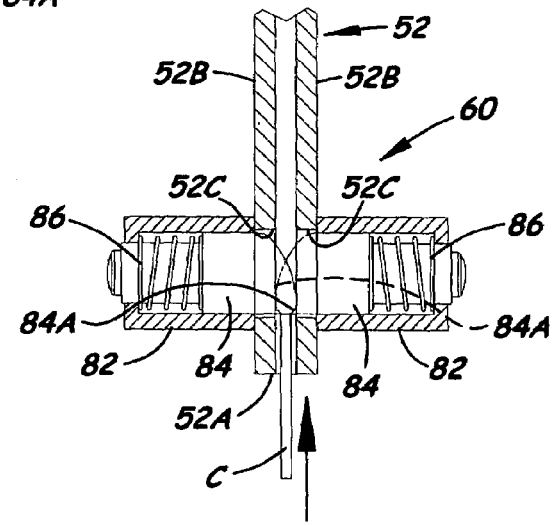
FIG. 13 is a view similar to that of FIGS. 11 and 12 now showing the inner ends of the dogs extending across the coin chute and the straight edges of the inner ends of the dogs blocking movement of a coin in reverse back upwardly through the coin chute.

More particularly, as best seen in FIGS. 10-13, the blocking device 60 includes a pair of casings 82 each mounted adjacent to one of a pair of opposite sides 52B of the coin chute 52, and a pair of dogs 84 mounted in the casings 82, and biased or loaded by springs 86 in the casings 82, so as to normally extend through slits 52C in the opposite sides 52B of the coin chute 52 and across the coin chute 52, as seen in FIG. 11. The use of the springs 86 and the curved edges 84B of the ends 84A of the dogs 84 permit the dogs 84 to movably yield and retract out of the coin chute 52 in response to contact by a coin C passing down the coin chute 52 from the coin-actuated mechanism 16 to the coin box 18, as seen in FIG. 12. However, straight edges 84C on the ends 84A of the dogs 84 prevent the dogs 84 from yielding in response to contact by a coin C passing up the coin chute 52 in the opposite or reverse direction from the coin box 18 to the coin-actuated mechanism 16, as seen in FIG. 13. The dogs 84 further are alternately movable in response to side-to-side shaking of the housing 14, one relative to the other, so as to be extendable or retractable into and from the coin chute 52 and thus ensure that at least one of the dogs 84 blocks a coin C from passing through the coin chute 52 from the coin box 18 toward the coin-actuated mechanism 16 to above the transverse wall 58 to where the coins would be accessible through the open top end 20A of the upper body 20 when the head 12 and top cap 44 are removed.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A coin-operated vending machine provided with anti-theft protection, comprising:

(a) a head adapted to store items of merchandise and dispense a preset number of the items at a time therefrom;

(b) a housing including an upper body having an outer wall defining an interior compartment open at upper and lower ends of said outer wall of said upper body and adapted to removably support said head on said upper end, and a lower base defining an interior cavity and having an open top adapted to removably support said upper body thereon;

(c) a coin box disposed in said interior cavity of said lower base;

(d) a first lock operable to permit removal and return of said coin box from and to said lower base;

(e) a coin-actuated mechanism mounted on said upper body and operable after deposit of at least one coin to cause dispensing of items from said head and ejection of the coin to said coin box in said lower base;

(f) a plurality of fastening elements disposed in said interior cavity of said lower base and said interior compartment of said upper body and adapted to fasten said lower base to said upper body, said lower base having a plurality of openings defined in a bottom thereof for allowing insertion of a tool, when said coin box is removed from said lower base, from exteriorly of said bottom of said lower base through said openings to reach and engage selected ones of said elements to fasten said lower base to said upper body such that access by the tool through said openings to said selected ones of said elements, and thus unfastening of said lower base from said upper body, cannot be reached and is thus blocked when said coin box is disposed in said interior cavity of said lower base; and (g) a transverse wall disposed across said interior compartment of said upper body, spaced from both said upper and lower open ends of said upper body, and attached from below and at a periphery of said transverse wall to said outer wall of said upper body such that said transverse wall blocks off access to said coin box in said interior cavity of said lower base by anyone reaching through said interior compartment of said upper body during when said head is removed from said upper body and such that said transverse wall cannot be detached from said upper body from above said transverse wall.

2. The machine of claim 1 wherein said plurality of fastening elements includes:

a plurality of fastener screws;

a plurality of first ledges fixed in said lower base at interior corners thereof adjacent said open top end thereof, each of said first ledges having a bore therethrough aligned with one of said openings in said bottom wall of said lower base when said upper body is supported on said lower base; and a plurality of second ledges fixed in said upper body at interior corners thereof and above said transverse wall, each of said second ledges having a threaded bore therein aligned with one of said openings in said bottom wall of said lower base and one of said bores in said first ledges when said upper body is supported on said lower base such that one of said screws can be inserted through said opening and through said corresponding aligned bore and threaded into said correspondingly aligned threaded bores to thereby fasten said lower base and upper body together.

3. The machine of claim 2 wherein said transverse wall at corners thereof receives fasteners in order to attach said transverse wall from below said transverse wall to lower ends of said second ledges in said upper body.

4. The machine of claim 1 further comprising:

a coin chute mounted in said interior compartment of said upper body and adapted to receive a coin from said coin-actuated mechanism and route the coin to a discharge end of said coin chute where the coin is discharged into said coin box located in said lower base of said housing, said transverse wall having another opening to accommodated extension therethrough of said coin chute from above to below said transverse wall.

5. The machine of claim 4 further comprising:

a motion-responsive coin blocking device mounted below said transverse wall adjacent to said coin chute and adapted to only permit coins to pass through said coin chute in one direction from the coin-actuated mechanism to the coin box.

6. The machine of claim 5 wherein said blocking device includes:

a pair of casings each mounted adjacent to one of a pair of opposite sides of said coin chute; and a pair of spring-loaded dogs each mounted to one of said casings and normally extending across said coin chute so as to be movable by yieldably retracting out of said coin chute in response to contact by a coin passing in said coin chute from said coin-actuated mechanism to said coin box;

said dogs further being alternately, one relative to the other, extendable or retractable into and from said coin chute in response to shaking of said housing so as to ensure that at least one of said dogs blocks a coin from passing through said coin chute from said coin box toward said coin-actuated mechanism above said transverse wall to where the coins would be accessible through said open top end of said upper body when said head is removed.

7. The machine of claim 1 further comprising:

a discharge chute mounted on said upper body and adapted to permit items dispensed from said head to be routed by said discharge chute to an exterior location on said upper body, said transverse wall being disposed at a level located between said coin-actuated mechanism and said discharge chute, said transverse wall having an opening accommodating passage therethrough of said discharge chute.

8. The machine of claim 1 further comprising:

a top cap restable on a top open end of said head so as to close said top open end thereof;

a central rod fixedly attached at a lower end to said transverse wall and extending therefrom upwardly above said transverse wall through said interior compartment of said upper body and therefrom through said head to said top cap; and a second lock operable to lock to an upper end of said central rod so as to hold and secure together said head and said upper body between said top cap and said transverse wall.

9. A coin-operated vending machine provided with anti-theft protection, comprising:

(a) a head adapted to store items of merchandise and dispense a preset number of the items at a time therefrom;

(b) a housing including an upper body having an outer wall defining an interior compartment open at upper and lower ends of said outer wall of said upper body and adapted to removably support said head on said upper end, and a lower base defining an interior cavity and having an open top adapted to removably support said upper body thereon;

(c) a discharge chute mounted on said upper body and adapted to permit items dispensed from said head to be routed by said discharge chute to an exterior location on said upper body;

(d) a coin box disposed in said interior cavity of said lower base;

(e) a first lock operable to permit removal and return of said coin box from and to said lower base;

(f) a coin-actuated mechanism mounted on said upper body and operable after deposit of a coin to cause dispensing of items from said head to said discharge chute and ejection of the coin to said coin box in said lower base;

(g) a plurality of fastening elements disposed in said interior cavity of said lower base and said interior compartment of said upper body and adapted to fasten said lower base to said upper body, said lower base having a plurality of openings defined in a bottom thereof for allowing insertion of a tool, when said coin box is removed from said lower base, from exteriorly of said bottom of said lower base through said openings to reach and engage selected ones of said elements to fasten said lower base to said upper body such that access by the tool through said openings to said selected ones of said elements, and thus unfastening of said lower base from said upper body, cannot be reached and is thus blocked when said coin box is disposed in said interior cavity of said lower base;

(h) a transverse wall attached from below and at a periphery of said transverse wall to said outer wall of said upper body, disposed across said interior compartment of said upper body, spaced from both said upper and lower open ends of said upper body at a level located between said coin-actuated mechanism and said discharge end of said discharge chute with said transverse wall having an opening accommodating passage therethrough of said discharge chute, such that said transverse wall blocks off access to said coin box in said interior cavity of said lower base by anyone reaching through said interior compartment of said upper body during when said head is removed from said upper body and such that said transverse wall cannot be detached from said upper body from above said transverse wall;

(i) a top cap restable on a top open end of said head so as to close said top open end thereof;

(j) a central rod fixedly attached at a lower end to said transverse wall and extending therefrom upwardly above said transverse wall through said interior compartment of said upper body and therefrom through said head to said top cap; and (k) a second lock operable to lock to an upper end of said central rod so as to hold and secure together said head and said upper body between said top cap and said transverse wall.

10. The machine of claim 9 wherein said plurality of fastening elements includes:

a plurality of fastener screws;

a plurality of first ledges fixed in said lower base at interior corners thereof adjacent said open top end thereof, each of said first ledges having a bore therethrough aligned with one of said openings in said bottom wall of said lower base when said upper body is supported on said lower base; and a plurality of second ledges fixed in said upper body at interior corners thereof and above said transverse wall, each of said second ledges having a threaded bore therein aligned with one of said openings in said bottom wall of said lower base and one of said bores in said first ledges when said upper body is supported on said lower base such that one of said screws can be inserted through said opening and through said corresponding aligned bore and threaded into said correspondingly aligned threaded bores to thereby fasten said lower base and upper body together.

11. The machine of claim 10 wherein said transverse wall at corners thereof receives fasteners in order to attach said transverse wall from below said transverse wall to lower ends of said second ledges in said upper body.

12. The machine of claim 9 further comprising:

a coin chute mounted in said interior compartment of said upper body and adapted to receive a coin from said coin-actuated mechanism and route the coin to a discharge end of said coin chute where the coin is discharged into said coin box located in said lower base of said housing, said transverse wall having another opening to accommodated extension therethrough of said coin chute from above to below said transverse wall.

13. The machine of claim 12 further comprising:

a motion-responsive coin blocking device mounted below said transverse wall adjacent to said coin chute and adapted to only permit coins to pass through said coin chute in one direction from the coin-actuated mechanism to the coin box.

14. The machine of claim 13 wherein said blocking device includes:

a pair of casings each mounted adjacent to one of a pair of opposite sides of said coin chute; and a pair of spring-loaded dogs each mounted to one of said casings and normally extending across said coin chute so as to be movable by yieldably retracting out of said coin chute in response to contact by a coin passing in said coin chute from said coin-actuated mechanism to said coin box;

said dogs further being alternately, one relative to the other, extendable or retractable into and from said coin chute in response to shaking of said housing so as to ensure that at least one of said dogs blocks a coin from passing through said coin chute from said coin box toward said coin-actuated mechanism above said transverse wall to where the coins would be accessible through said open top end of said upper body when said head and top cover are removed.

* * * * *